US009265093B2

(12) United States Patent
Waechter et al.

(10) Patent No.: US 9,265,093 B2
(45) Date of Patent: Feb. 16, 2016

(54) HEATING ROD

(71) Applicant: BorgWarner BERU Systems GmbH, Ludwigsburg (DE)

(72) Inventors: Ralph Waechter, Pfinztal (DE); Michael Stoerzinger, Bretten (DE); Bernd Halbrock, Koenigsbach-Stein (DE); Alexander Daun, Maulbronn (DE); Norbert Ernst, Billigheim-Ingenheim (DE); Klaus Lehmann, Oberderdingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 253 days.

(21) Appl. No.: 13/950,740

(22) Filed: Jul. 25, 2013

(65) Prior Publication Data

US 2014/0034634 A1 Feb. 6, 2014

(30) Foreign Application Priority Data

Aug. 2, 2012 (DE) ..... 10 2012 107 113

(51) Int. Cl.

| | |
|---|---|
| ***H05B 3/40*** | (2006.01) |
| ***H05B 3/26*** | (2006.01) |
| ***H05B 3/24*** | (2006.01) |

(52) U.S. Cl.

CPC ..... *H05B 3/265* (2013.01); *H05B 3/24* (2013.01); *H05B 2203/02* (2013.01); *H05B 2203/023* (2013.01)

(58) Field of Classification Search

CPC ..... H05B 3/06; H05B 3/141; H05B 3/15; H05B 3/244; H05B 3/24; H05B 3/22; H05B 3/10; H05B 2203/02; H05B 2203/023

See application file for complete search history.

(56) References Cited

U.S. PATENT DOCUMENTS

| | | | | |
|---|---|---|---|---|
| 7,816,630 | B2 | 10/2010 | Hamburger et al. | |
| 2007/0068913 | A1 * | 3/2007 | Zeyen et al. ..... | 219/201 |

FOREIGN PATENT DOCUMENTS

| | | | |
|---|---|---|---|
| EP | 1 467 599 | A2 | 4/2004 |

* cited by examiner

*Primary Examiner* — Shawntina Fuqua

(74) *Attorney, Agent, or Firm* — Bose McKinney & Evans LLP

(57) ABSTRACT

The invention relates to a heating rod comprising a tube housing, at least one ceramic heating element, which is arranged in the tube housing, a first contact plate, which in the tube housing bears against the heating element or the heating elements, and an insulating frame, which surrounds the longitudinal edges of the first contact plate. In accordance with this disclosure, a second contact plate is provided, which carries a second insulating frame, wherein the at least one heating element is arranged between the two contact plates and the two frames are plugged into one another.

10 Claims, 2 Drawing Sheets

HEATING ROD

RELATED APPLICATIONS

This application claims priority to DE 10 2012 107 113.6, filed Aug. 2, 2012 which is hereby incorporated by reference in its entirety.

BACKGROUND

The invention generally relates to a heating rod having a tube housing, at least one ceramic heating element arranged in the tube housing, a first contact plate, which in the tube housing bears against the heating element or the heating elements, and an insulating frame which surrounds the longitudinal edges of the first contact plate, and more particularly, to a heating rod which carries a second contact plate.

SUMMARY

With a heating rod according to this disclosure, the ceramic heating element is arranged between two contact plates, which are each electrically insulated with respect to the tube housing. The electrical safety of the heating rod is thus increased, and in particular the heating rod can also be operated with greater electrical voltages, for example at voltages of 200 V and more. The frames of the two contact plates of a heating rod according to the invention are plugged into one another, that is to say engage in one another. Here, the longitudinal sides of the ceramic heating element or of the ceramic heating elements are advantageously covered completely by the two frames, thus increasing the dielectric strength. The engagement of the two frames in one another additionally has the advantage that a connection is thus created between the two frames, which hinders an accidental detachment of the two frames from one another during the assembly of the heating rod. The two contact plates with the corresponding frames and the at least one ceramic heating element arranged therebetween thus form a unit that can be easily preassembled, and can be easily handled and inserted into the heating tube. The engagement of the two frames in one another thus has considerable manufacturing advantages.

The two frames of a heating rod according to this disclosure engage in one another by means of a plug-in connection, for example by means of a tongue-and-groove connection. A tongue-and-groove connection makes it possible to join together the two frames in a simple manner and, as a result of friction or clamping, can reliably prevent the two frames from accidentally detaching from one another again before the insertion into the tube.

In a further advantageous refinement of this disclosure, the contact plates protrude from the tube housing via an extension. Here, it is preferable if the two frames each have a transverse limb at the end at which the contact plates protrude from the tube housing, said transverse limbs having a greater width than the longitudinal limbs of said frames. It is particularly advantageous if these two transverse limbs engage in one another, that is to say are plugged into one another. The mechanical stability of the assembly that is slid into the tube housing can thus be increased. Each of the two transverse limbs involved in the plug-in connection preferably has a raised portion, which engages in an indentation in the respective other transverse limb.

The frames can be injection molded around the contact plates. It is also possible however for the contact plates to be produced separately and fixed subsequently to the contact plates, for example by sliding the frames onto the contact plates or by inserting the contact plates into the frames. In both variants, the frames can be formed such that they completely cover a rear face of the contact plates facing away from the at least one heating element. It is also possible however for the frames to leave the rear face of the contact plates free and for said rear face of the contact plate in question to be covered by an insulating strip.

In one advantageous refinement in accordance with these teachings, a portion of the contact plate is embedded in at least one of the transverse limbs of the frames, the distance of said portion from the opposed contact plate being reduced by a bend. With a frame injection moulded around the contact plate, a form-fit connection between the frame and contact plate can thus be produced. The bend may have a small bend radius, that is to say may be formed as a kink. For example, the contact plate can be deformed by stamping. A flat portion, which is parallel with respect to a plate portion against which the heating element or the heating elements bear, preferably adjoins the bend.

In a further advantageous refinement, the two frames are formed identically. This simplifies the storekeeping of the required components and reduces manufacturing costs.

In a further advantageous refinement of the invention, the longitudinal limbs of the frames each have at least one step. Leakage currents from a contact plate or heating element to the tube housing can thus be reduced and the dielectric strength thus increased.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
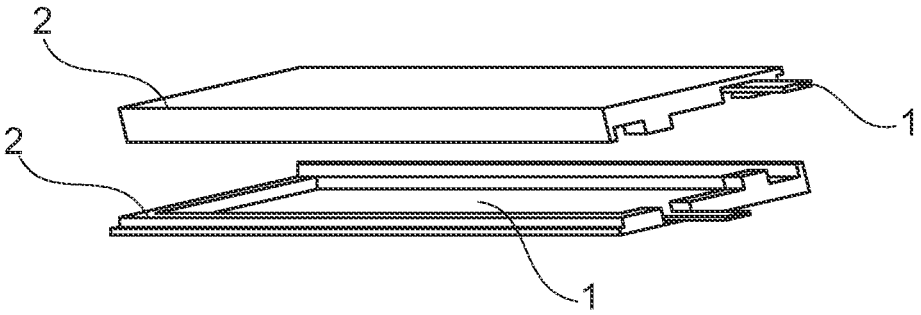
FIG. 1 shows two contact plates with corresponding frames.
Figure 2:
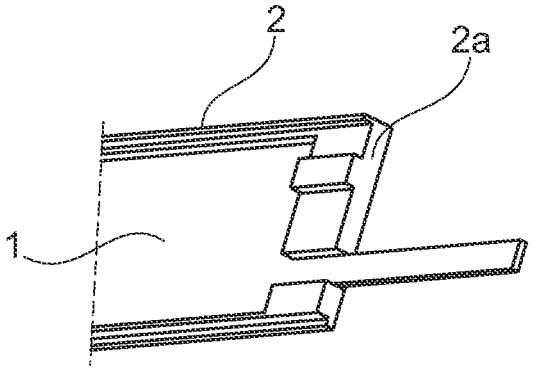
FIG. 2 shows a detailed view of FIG. 1.

FIG. 1 shows two contact plates 1, which each carry an insulating frame 2. One or more ceramic heating elements, for example PTC heating elements, are arranged between these two contact plates 1. The two frames 2 engage in one another. FIG. 2 shows that a transverse limb 2*a* of the frame 2 comprises a recess and a corresponding raised portion. When two frames 2 are plugged together, this raised portion of one frame 2 engages in the matching recess in the other frame 2. The two frames 2 therefore engage in one another via a plug-in connection. This plug-in connection is formed as a tongue-and-groove connection in the illustrative embodiment shown. The transverse limbs 2*a* may have a greater width than the longitudinal limbs in order to strengthen a plug-in connection formed by the transverse limbs.

The two frames 2 formed identically engage around the longitudinal edges of the contact plates 1. The frames in the illustrative embodiment in FIGS. 1 and 2 are fabricated as plastic parts, into each of which a contact plate 1 is then inserted.

The longitudinal limbs of the frame 2 each have at least one step. The leakage path from a contact plate to a tube housing can be increased in this way, thus improving the dielectric strength. This step may be part of a tongue or groove.

Figure 3:
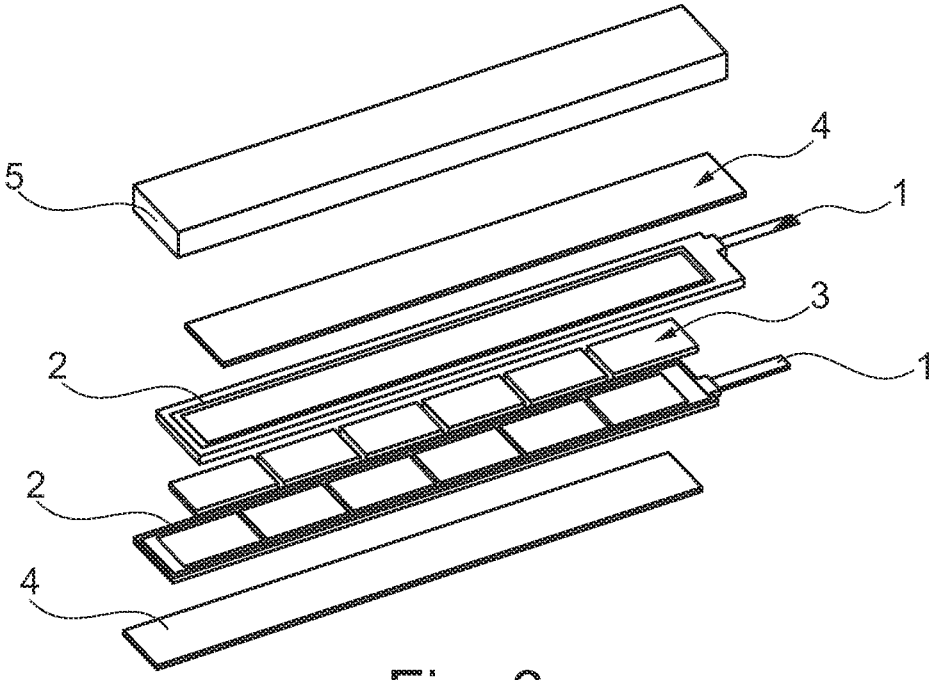
FIG. 3 shows an exploded illustration of a further illustrative embodiment.

FIG. 3 shows an exploded illustration of a further illustrative embodiment. This embodiment differs from the above-described embodiment in that the frames 2 have been produced by insert moulding of the contact plates 1. A further difference is that, in the embodiment illustrated in FIG. 3, the frames 2 leave uncovered a rear face of the contact plates 1 facing away from the heating elements 3. A strip 4 formed from an insulating material, for example from plastic or ceramic, lies on this rear face of the contact plates 1.

In the embodiment in FIGS. 1 and 2, the frames by contrast completely cover the rear face of the contact plates 1 facing away from the heating elements 3. However, even with a separately produced frame 2, in which a contact plate 1 is inserted or which is slid over a contact plate 1, a rear face of the contact plate 1 can also remain free and can be insulated with respect to the tube housing 5 by means of a separate insulating layer, for example a strip made of insulating material.

In the embodiment in FIG. 3 also, the two frames 2 engage in one another. A plug-in connection between the two frames 2 may advantageously be produced in this case too as a tongue-and-groove connection.

The limbs of the frames 2 each have at least one step. Leakage currents can thus be counteracted. In addition, the steps can be involved in the tongue-and-groove connection between the two frames 2.

The frames 2 may have transverse crosspieces, which each sit between adjacent heating elements 3. The heating elements 3 can thus be even better positioned by the frames 2. Transverse crosspieces are not necessary however.

Figure 4:
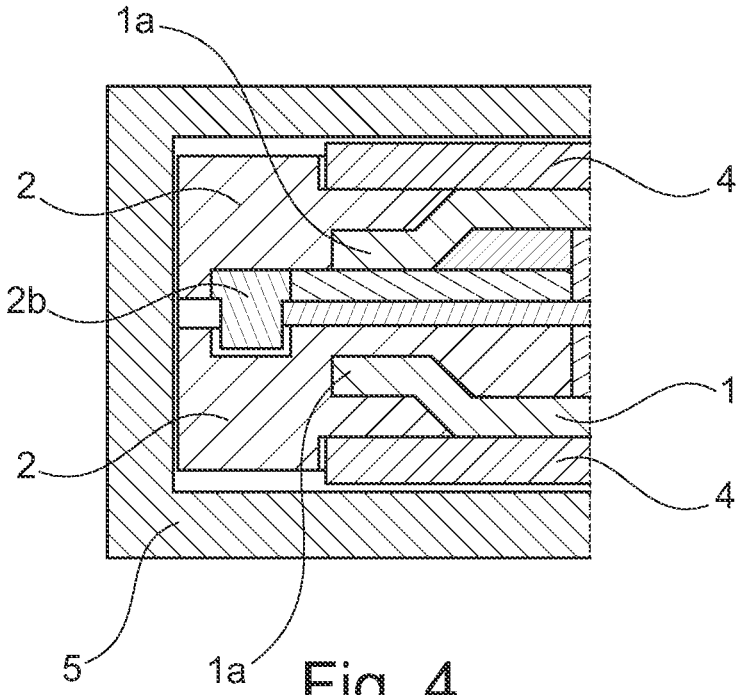
FIG. 4 shows a longitudinal section of an end portion of a heating rod according to FIG. 3.

FIG. 4 shows a longitudinal sectional view of an end portion of the heating rod according to FIG. 3. It can be clearly seen that a tongue 2*b* of the frame 2 illustrated in the figure above engages in a groove in the frame 2 illustrated at the bottom in FIG. 4. FIG. 4 also shows that an end portion 1*a* of the contact plate 1 has a reduced distance from the opposed contact plate 1. The contact plates specifically each have a bend before the end portion 1*a*. The contact plates 1 are therefore held by the frames 2 with a form fit.

Figure 5:
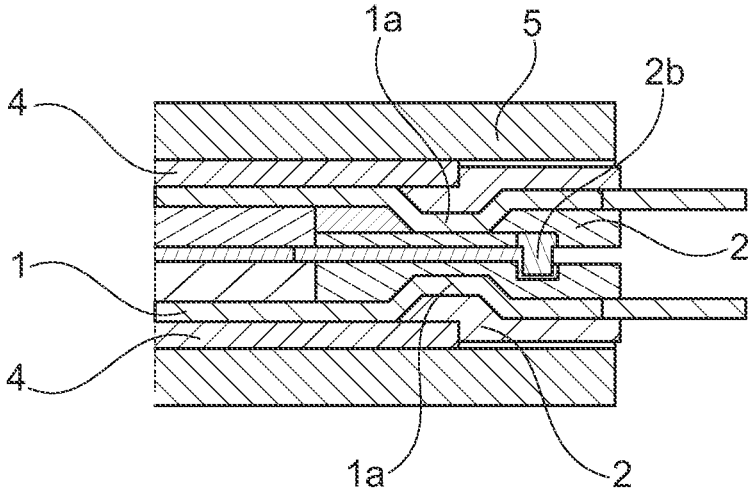
FIG. 5 shows a longitudinal section of the other end portion of a heating rod according to FIG. 3.

FIG. 5 shows a longitudinal section of the other end of the heating rod. At this end, the contact plates 1 protrude from the tube housing 5, preferably via an extension, which has a reduced width, that is to say a smaller width than the portion of the contact plate 1 against which the heating elements 3 bear. The extensions preferably are not arranged above one another, but are arranged laterally offset from one another.

It can be seen in FIG. 5 that a tongue 2*b* of the upper frame 2 engages in a groove in the lower frame 2. In contrast to the exemplary embodiment in FIGS. 1 and 2, the tongue and groove extend along the transverse limb, that is to say not in the longitudinal direction of the frame 2, but transverse thereto. Here, a first half of a transverse limb 2*a* of a frame 2 preferably forms a tongue 2*b*, and the second half of the transverse limb forms the groove, and therefore identically formed frames 2 can be plugged together. Also at the end of the tube housing 5 shown in FIG. 5, a portion 1*a* of the contact plate 1 is embedded in the transverse limb of the frame 2, the distance of said portion from the opposed contact plate 1 being reduced by a bend.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heating rod, comprising:

a tube housing;

at least one ceramic heating element arranged in the tube housing;

a first contact plate, which in the tube housing bears against the heating element or the heating elements;

an insulating frame, which surrounds the longitudinal edges of the first contact plate; and a second contact plate, which carries a second insulating frame;

wherein the at least one ceramic heating element is arranged between the two contact plates and the two frames are plugged into one another.

2. The heating rod according to claim 1, wherein the two frames are plugged into one another in the form of a tongue-and-groove connection.

3. The heating rod according to claim 1, wherein the contact plates protrude from the tube housing with an extension.

4. The heating rod according to claim 3, wherein the contact plates have a reduced width outside the tube housing.

5. The heating rod according to claim 4, wherein the extensions of the two contact plates are offset from one another.

6. The heating rod according to claim 3, wherein the two frames each have a transverse limb at the end at which the contact plates protrude from the tube housing, said transverse limbs having a greater width than the longitudinal limbs of said frames.

7. The heating rod according to claim 6, wherein the two transverse limbs engage in one another.

8. The heating rod according to claim 1, wherein the two frames are each produced by insert moulding one of the two contact plates.

9. The heating rod according to claim 1, wherein a portion of the contact plate is embedded in at least one of the transverse limbs of the frame, the distance of said portion from the opposed contact plate being reduced by a bend.

10. The heating rod according to claim 1, wherein the longitudinal limbs of the frames have at least one step.

* * * * *